US011639287B2

(12) United States Patent
Hsieh

(10) Patent No.: US 11,639,287 B2
(45) Date of Patent: May 2, 2023

(54) HAND TOOL

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 166 days.

(21) Appl. No.: 17/199,363

(22) Filed: Mar. 11, 2021

(65) Prior Publication Data

US 2021/0309504 A1 Oct. 7, 2021

(30) Foreign Application Priority Data

Apr. 1, 2020 (TW) ..... 109111350

(51) Int. Cl.

| | |
|---|---|
| ***B66F 15/00*** | (2006.01) |
| ***B25G 3/02*** | (2006.01) |
| ***B25B 23/00*** | (2006.01) |
| ***B25G 1/04*** | (2006.01) |

(52) U.S. Cl.

CPC ..... *B66F 15/00* (2013.01); *B25B 23/0035* (2013.01); *B25G 3/02* (2013.01); *B25G 1/043* (2013.01)

(58) Field of Classification Search

CPC . B66F 15/00; B25B 23/0035; B25B 23/0028; B25G 3/02; B25G 1/043

USPC ..... 81/177.85, 177.1, 177.2, 180.1; 7/166, 7/138

See application file for complete search history.

(56) References Cited

U.S. PATENT DOCUMENTS

| | | | | |
|---|---|---|---|---|
| 2,627,078 A * | 2/1953 | Eliot | B25F 1/00 | 81/20 |
| 2,921,773 A * | 1/1960 | Hoelzer | B65G 7/12 | 403/103 |
| 5,931,063 A * | 8/1999 | Kuo | B25B 13/08 | 81/186 |
| 7,025,331 B2 * | 4/2006 | Whelan | B25F 1/02 | 254/25 |
| 7,311,018 B1 * | 12/2007 | Liou | B25G 1/005 | 81/177.5 |

(Continued)

FOREIGN PATENT DOCUMENTS

| | | |
|---|---|---|
| CN | 204382222 U | 6/2015 |
| TW | M478581 U | 5/2014 |
| TW | 202000399 A | 1/2020 |

*Primary Examiner* — Don M Anderson
*Assistant Examiner* — Jason Khalil Hawkins
(74) *Attorney, Agent, or Firm* — CKC & Partners Co., LLC

(57) ABSTRACT

A prying head is provided in the present disclosure. The prying head, which is used in cooperation with a hand tool, includes a prying portion, a supporting portion and an assembling portion. The prying portion includes a ground-abutting surface and an article-abutting surface. The article-abutting surface is connected to the ground-abutting surface to form a sharp edge. The supporting portion is connected to the prying portion and includes a curved surface. The curved surface is connected to the ground-abutting surface and the article-abutting surface, so as to make an end of the supporting portion away from the sharp edge into a curved form. The assembling portion is connected to the supporting portion and includes a blind hole. The blind hole is recessed from an end of the assembling portion away from the sharp edge.

6 Claims, 8 Drawing Sheets

(56) References Cited

U.S. PATENT DOCUMENTS

| | | | | |
|---|---|---|---|---|
| 8,201,806 | B2 * | 6/2012 | Liou | B25G 3/26 254/27 |
| 8,215,617 | B2 * | 7/2012 | Liou | B66F 15/00 254/131.5 |
| 9,486,901 | B2 * | 11/2016 | Tsai | B25G 1/063 |
| 10,486,952 | B2 * | 11/2019 | Su | B66F 15/00 |
| 11,401,147 | B2 * | 8/2022 | Su | B66F 15/00 |
| 2014/0260829 | A1 * | 9/2014 | Alfinito | B25B 23/0021 81/177.85 |

* cited by examiner

HAND TOOL

RELATED APPLICATIONS

This application claims priority to Taiwan Application Serial Number 109111350, filed Apr. 1, 2020, which is herein incorporated by reference.

BACKGROUND

Technical Field

The present disclosure relates to a tool and a tool component. More particularly, the present disclosure relates to a prying head which can be detachably assembled with a handle and a hand tool with the prying head.

Description of Related Art

Tools, such as crowbar and wrench, are often used while repairing articles or during a construction. In short, the crowbar and the wrench are both levers. Workers can easily pry apart fixed articles or lift heavy articles with the help of crowbar. The wrench is used to loosen or tighten fasteners such as bolts or nuts. It is pretty convenient to use the abovementioned tools, which is favorable for enhancing the working efficiency of workers.

Furthermore, crowbar, wrench and other tools in relatively large sizes must be used to repair massive articles. These large tools have relatively long effort arms (handles), so as to easily apply forces or operate the components which are in small slits and difficult to be touched. In order to make the works go smoothly, the workers will prepare the large tools needed at a time. However, due to the huge volumes and weights of the large tools, the burden of the workers increases as simultaneously bringing several large tools.

In this regard, it is still an unsolved problem to reduce the total volume of large crowbar and wrench, while the original functions of these two tools remain.

SUMMARY

According to one aspect of the present disclosure, a prying head, which is used in cooperation with a hand tool, includes a prying portion, a supporting portion and an assembling portion. The prying portion includes a ground-abutting surface and an article-abutting surface. The article-abutting surface is connected to the ground-abutting surface to form a sharp edge. The supporting portion is connected to the prying portion and includes a curved surface. The curved surface is connected to the ground-abutting surface and the article-abutting surface, so as to make an end of the supporting portion away from the sharp edge into a curved form. The assembling portion is connected to the supporting portion and includes a blind hole. The blind hole is recessed from an end of the assembling portion away from the sharp edge.

According to another aspect of the present disclosure, a hand tool includes a prying head, a wrench head and a handle. The prying head includes a prying portion, a supporting portion and an assembling portion. The prying portion includes a ground-abutting surface and an article-abutting surface. The article-abutting surface is connected to the ground-abutting surface to form a sharp edge. The supporting portion is connected to the prying portion and includes a curved surface. The curved surface is connected to the ground-abutting surface and the article-abutting surface, so as to make an end of the supporting portion away from the sharp edge into a curved form. The assembling portion is connected to the supporting portion and includes a blind hole. The blind hole is recessed from an end of the assembling portion away from the sharp edge. The wrench head includes an engaging hole. The handle includes an inserting portion. The inserting portion is detachably engaged with the engaging hole of the wrench head or the blind hole of the prying head.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
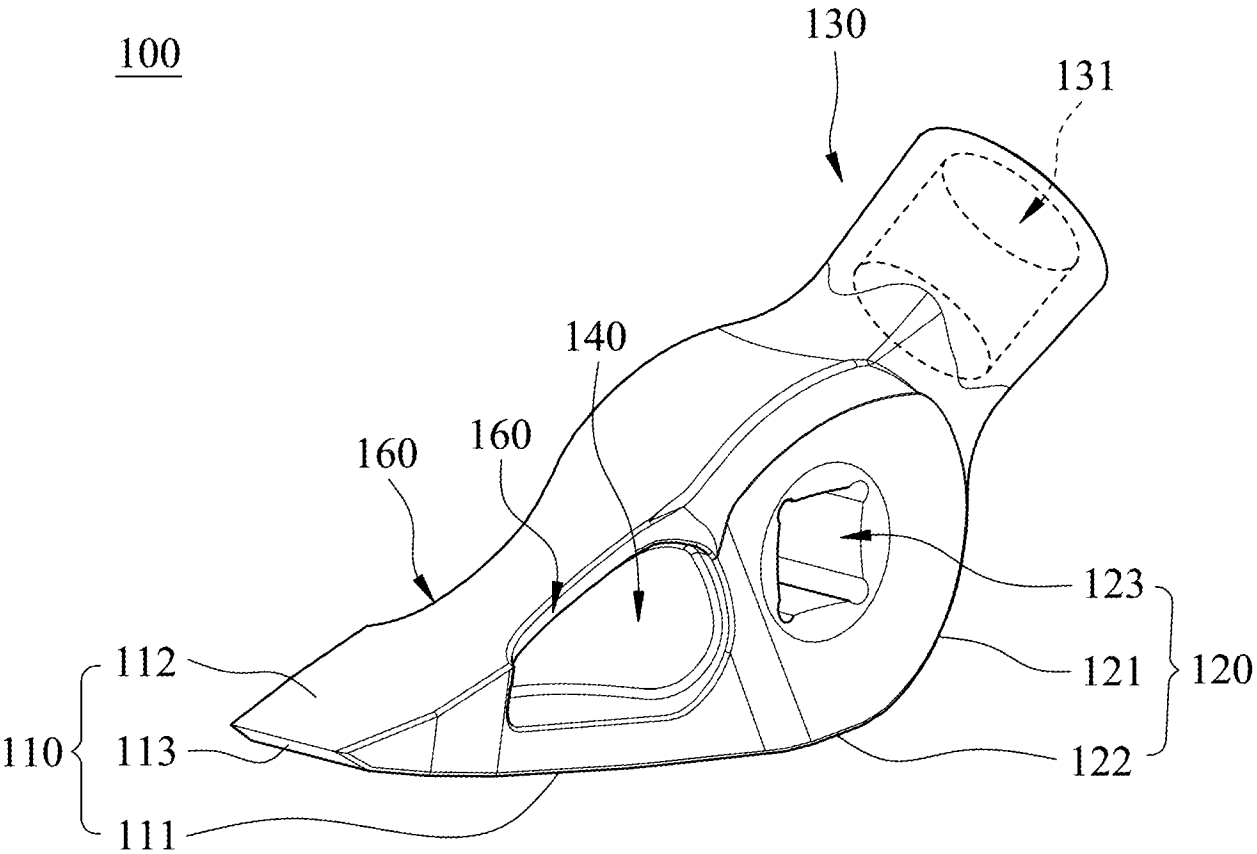
FIG. 1 is a three-dimensional schematic view of a prying head according to one embodiment of one aspect in the present disclosure.
Figure 2:
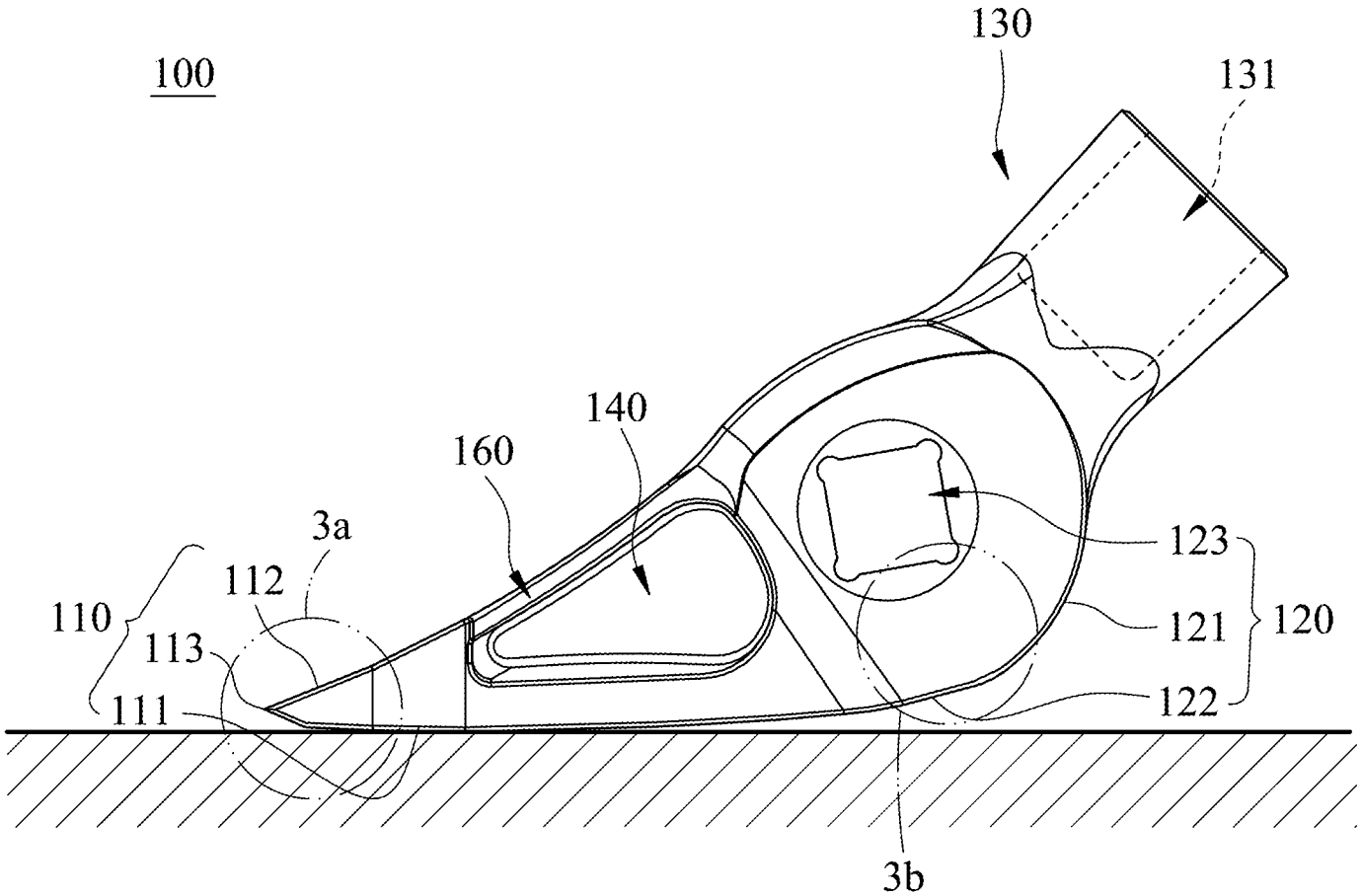
FIG. 2 is a front schematic view of the prying head of FIG. 1.

Please refer to FIG. 1 and FIG. 2. FIG. 1 is a three-dimensional schematic view of a prying head 100 according to one embodiment of one aspect in the present disclosure. FIG. 2 is a front schematic view of the prying head 100 of FIG. 1. The prying head 100 is used in cooperation with a hand tool. The prying head 100 includes a prying portion 110, a supporting portion 120 and an assembling portion 130. The supporting portion 120 is connected to the prying portion 110, and the assembling portion 130 is connected to the supporting portion 120.

In detail, the prying portion 110 includes a ground-abutting surface 111 and an article-abutting surface 112, and the article-abutting surface 112 is connected to the ground-abutting surface 111 to form a sharp edge 113. As using the prying head 100, it is easy for the sharp edge 113 to slide into the gap between the heavy article and the ground. Then, the heavy article is slightly lifted and the prying portion 110 can be smoothly pushed to the bottom of the heavy article.

Figure 3B:
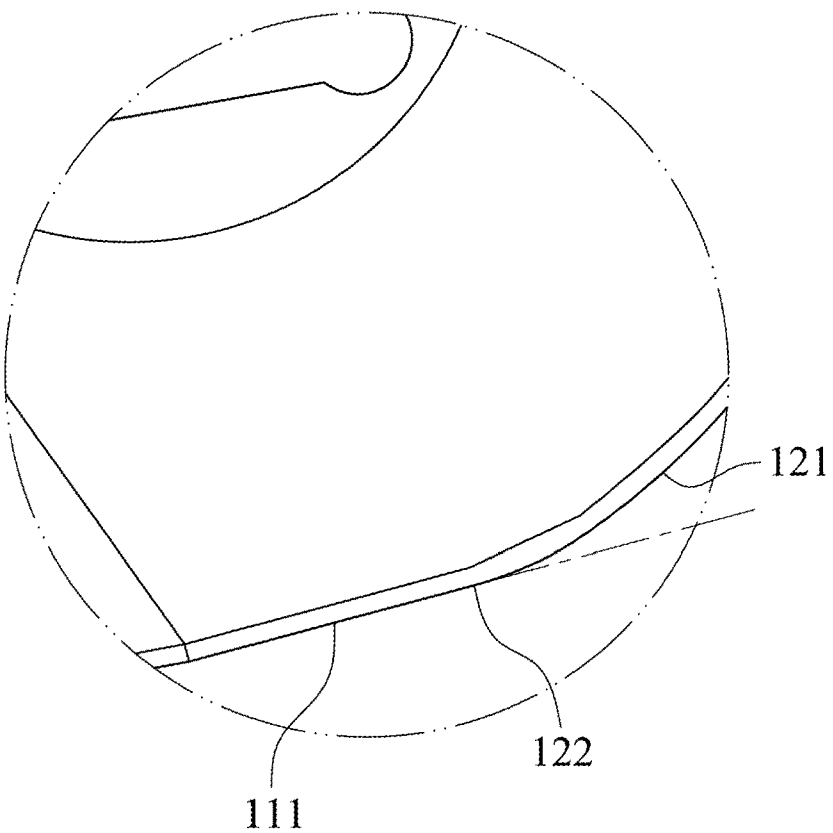
FIG. 3B is a partial enlarged schematic view of a part 3*b* in the prying head of FIG. 2.
Figure 3A:
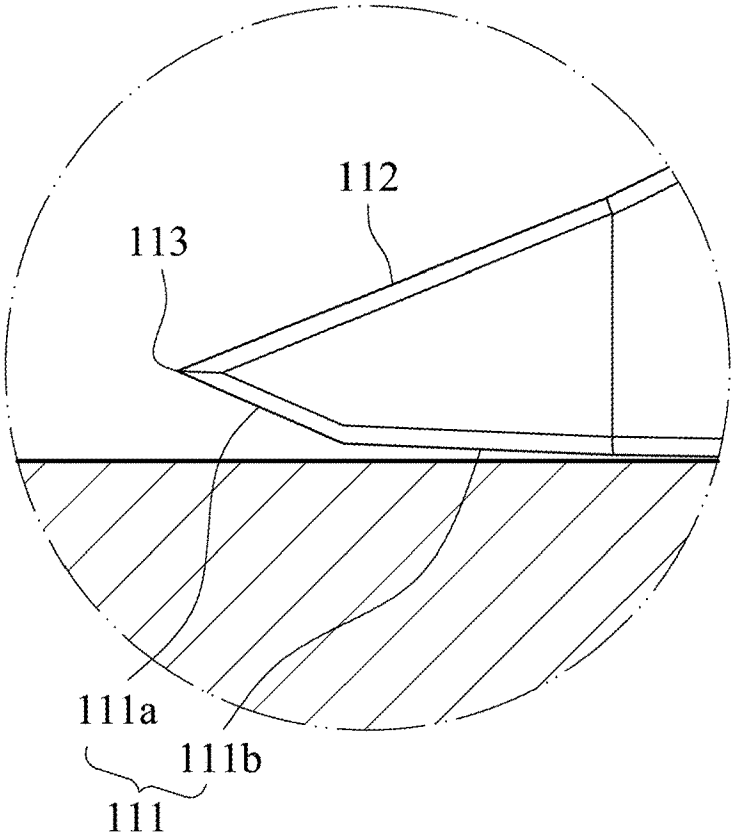
FIG. 3A is a partial enlarged schematic view of a part 3*a* in the prying head of FIG. 2.

Please also refer to FIG. 3A. FIG. 3A is a partial enlarged schematic view of a part 3*a* in the prying head 100 of FIG. 2. The ground-abutting surface 111 of the prying head 100 can be in a planar form, or be divided into a sudden-narrowing part 111*a* and a gradual-narrowing part 111*b*. The sudden-narrowing part 111*a* is closer to the sharp edge 113 than the gradual-narrowing part 111*b*. A narrowing rate between the sudden-narrowing part 111*a* and the article-abutting surface 112 is higher than a narrowing rate between the gradual-narrowing part 111*b* and the article-abutting surface 112. In short, along the direction of the part away from the sharp edge 113 to the sharp edge 113, the ground-abutting surface 111 and the article-abutting surface 112 become closer and closer. The narrowing rate represents the rate of the surfaces becoming closer. Due to the difference between the narrowing rates, the prying portion 110 with the sudden-narrowing part 111*a* slightly tilts upwardly. Therefore, as pushing the prying head 100 to the bottom of the heavy article, the heavy article can be first lifted by the prying portion 110 with the sudden-narrowing part 111*a*, and the gap between the heavy article and the ground is enlarged to facilitate the prying portion 110 entering the bottom of the heavy article.

Please refer to FIG. 1 and FIG. 2. The supporting portion 120 includes a curved surface 121. The curved surface 121 is connected to the ground-abutting surface 111 and the article-abutting surface 112, so as to make an end of the supporting portion 120 away from the sharp edge 113 into a curved form. In order to lift the heavy article, force is applied downwardly on one side of the prying head 100 adjacent to the supporting portion 120, and the prying portion 110 at the other side rises. The curved supporting portion 120 makes the prying head 100 rotate more smoothly on the ground as applying force, which is favorable for smoothly lifting the heavy article.

Please also refer to FIG. 3B. FIG. 3B is a partial enlarged schematic view of a part 3*b* in the prying head 100 of FIG. 2. A fulcrum 122 can be formed at a connection between the curved surface 121 and the ground-abutting surface 111. The fulcrum 122 can facilitate the leverage of the supporting portion 120 and the prying portion 110, so as to lift the prying portion 110 loaded with the heavy article by a reduced force.

Please refer to FIG. 1 and FIG. 2. The supporting portion 120 further includes a through hole 123. The through hole 123 penetrates from a first side surface of the supporting portion 120 to a second side surface of the supporting portion 120 opposite to the first side surface. The through hole 123 is configured for an engaging end of a wrench head being engaged with, and the process of assembling the prying head 100 and the wrench head and the instruction will be explained in another aspect of the present disclosure, and the details will not be given herein.

The assembling portion 130 includes a blind hole 131, which is recessed from an end of the assembling portion 130 away from the sharp edge 113. The blind hole 131 is configured for assembling with the elements having similar sizes to the blind hole 131. That is, any handles including the elements with corresponding sizes can be assembled with the prying head 100, which brings more usages of the prying head 100.

Figure 4:
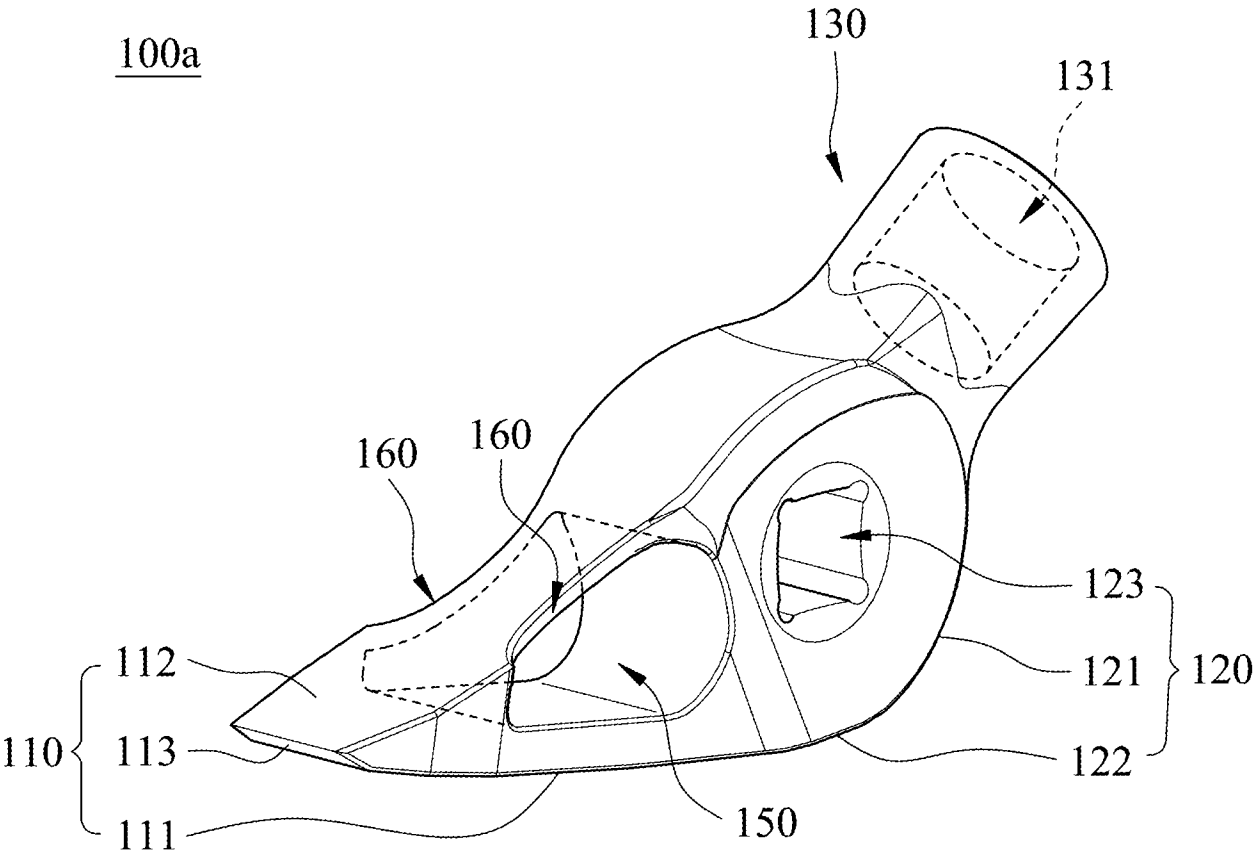
FIG. 4 is a three-dimensional schematic view of a prying head according to another embodiment in the present disclosure.

Please refer to FIG. 1 and FIG. 4. FIG. 4 is a three-dimensional schematic view of a prying head 100*a* according to another embodiment in the present disclosure. The prying head of the present disclosure can further include at least one recessed cavity 140, as shown in FIG. 1, or further include at least one through cavity 150, as shown in FIG. 4.

First, please refer to FIG. 1. The at least one recessed cavity 140 is recessed from a side surface of the prying portion 110. Through arranging the at least one recessed cavity 140, the total weight of the prying head 100 can be decreased and the burden of carrying the prying head 100 is reduced. For example, in the present embodiment, the number of the at least one recessed cavity 140 can be two. The two recessed cavities 140 can be arranged on two side surfaces of the prying portion 110, respectively. The positions and the shapes of the two recessed cavities 140 are preferable to being symmetric, which prevents the center of gravity of the prying head 100 offsetting. Thus, it is more handy to take or use the prying head 100. Please note that the features, such as number, position and shape, of the at least one recessed cavity 140 are not limited in the present disclosure.

Please refer to FIG. 4. The at least one through cavity 150 penetrates from a first side surface of the prying portion 110 to a second side surface of the prying portion 110 opposite to the first side surface. Through arranging the at least one through cavity 150, the total weight of the prying head 100*a* can be also decreased and the burden of carrying the prying head 100*a* is reduced.

Moreover, the prying head 100, 100*a* of the present disclosure can further include at least one recessed arc 160, which is recessed from an edge of the article-abutting surface 112. Through arranging the at least one recessed arc 160, the total weight of the prying head 100, 100*a* can be also decreased. For example, the number of the at least one recessed arc 160 can be two. The two recessed arcs 160 can be arranged at two edges, along which the article-abutting surface 112 meets the two side surfaces of the prying portion 110, respectively. Please note that the features, such as number, position and shape, of the at least one recessed arc 160 are not limited in the present disclosure.

Figure 5:
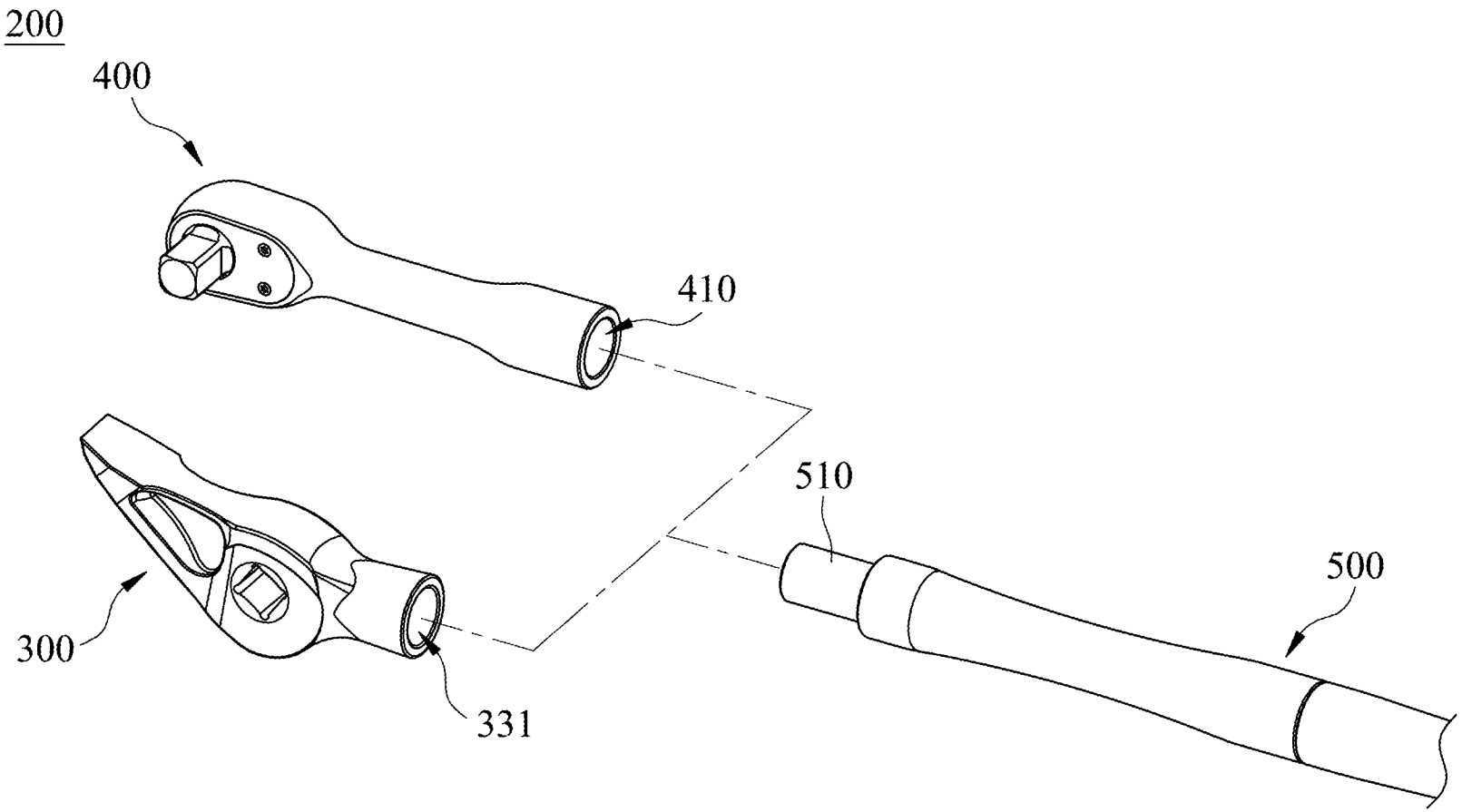
FIG. 5 is one three-dimensional explosive schematic view of a hand tool according to an embodiment of another aspect in the present disclosure.

Please refer to FIG. 5. FIG. 5 is one three-dimensional explosive schematic view of a hand tool 200 according to an embodiment of another aspect in the present disclosure. The hand tool 200 includes a prying head 300, a wrench head 400 and a handle 500. The structure of the prying head 300 is the same as the aforementioned prying head 100, and the details will not be given herein. The wrench head 400 includes an engaging hole 410. The handle 500 includes an inserting portion 510, and the inserting portion 510 is detachably engaged with the engaging hole 410 of the wrench head 400 or the blind hole 331 of the prying head 300. Therefore, different components can be assembled with the handle 500 under different conditions, and the hand tool 200 will become a crowbar or a wrench.

In other embodiments, the handle can be divided into several sections. Each section can include an engaging hole and/or an inserting portion, that is, each section can be connected to other sections through the engaging hole and/or the inserting portion. The handle with the structure of several sections will facilitate storing the hand tool. The total length of the hand tool can be changed by assembling different numbers of sections, so as to properly adjust the length of the hand tool to meet the different requirements.

Figure 6:
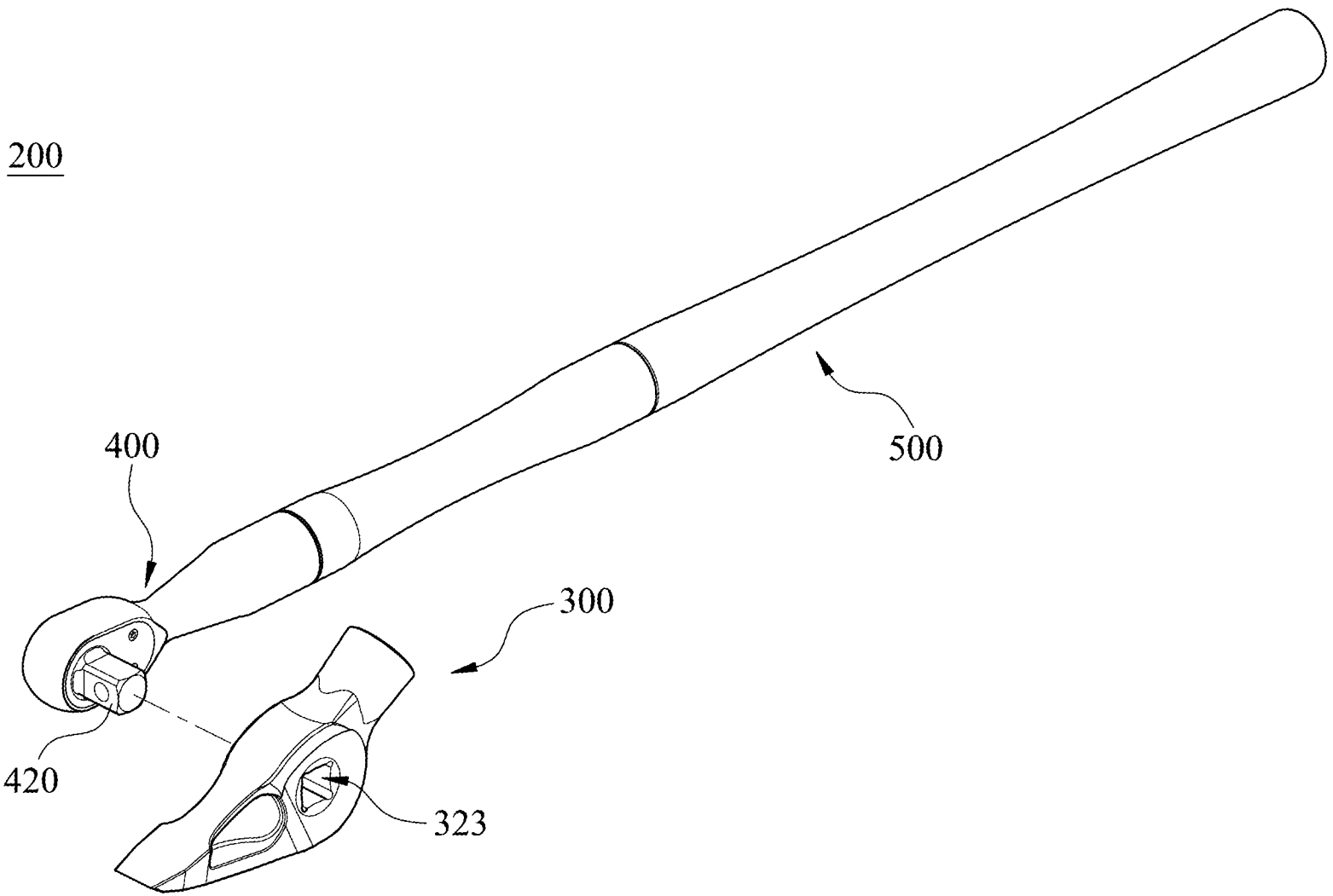
FIG. 6 is another three-dimensional explosive schematic view of the hand tool of FIG. 5.

Please refer to FIG. 6. FIG. 6 is another three-dimensional explosive schematic view of the hand tool 200 of FIG. 5. The wrench head 400 can further include an engaging end 420, and the engaging end 420 protrudes from a side surface of the wrench head 400. The wrench head 400 is detachably engaged with the through hole 323 of the prying head 300 through the engaging end 420, so as to assemble the prying head 300 with the wrench head 400. The engaging end 420 and the through hole 323 have corresponding structures. The shape of the through hole 323 can be designed according to the engaging end of the conventional wrench for convenient manufacturing and assembling. For example, as in FIG. 6, the engaging end 420 is a conventional cuboidal drive tang, and the through hole 323 is designed to have a cuboidal shape correspondingly. However, the present disclosure is not limited thereto.

Figure 7:
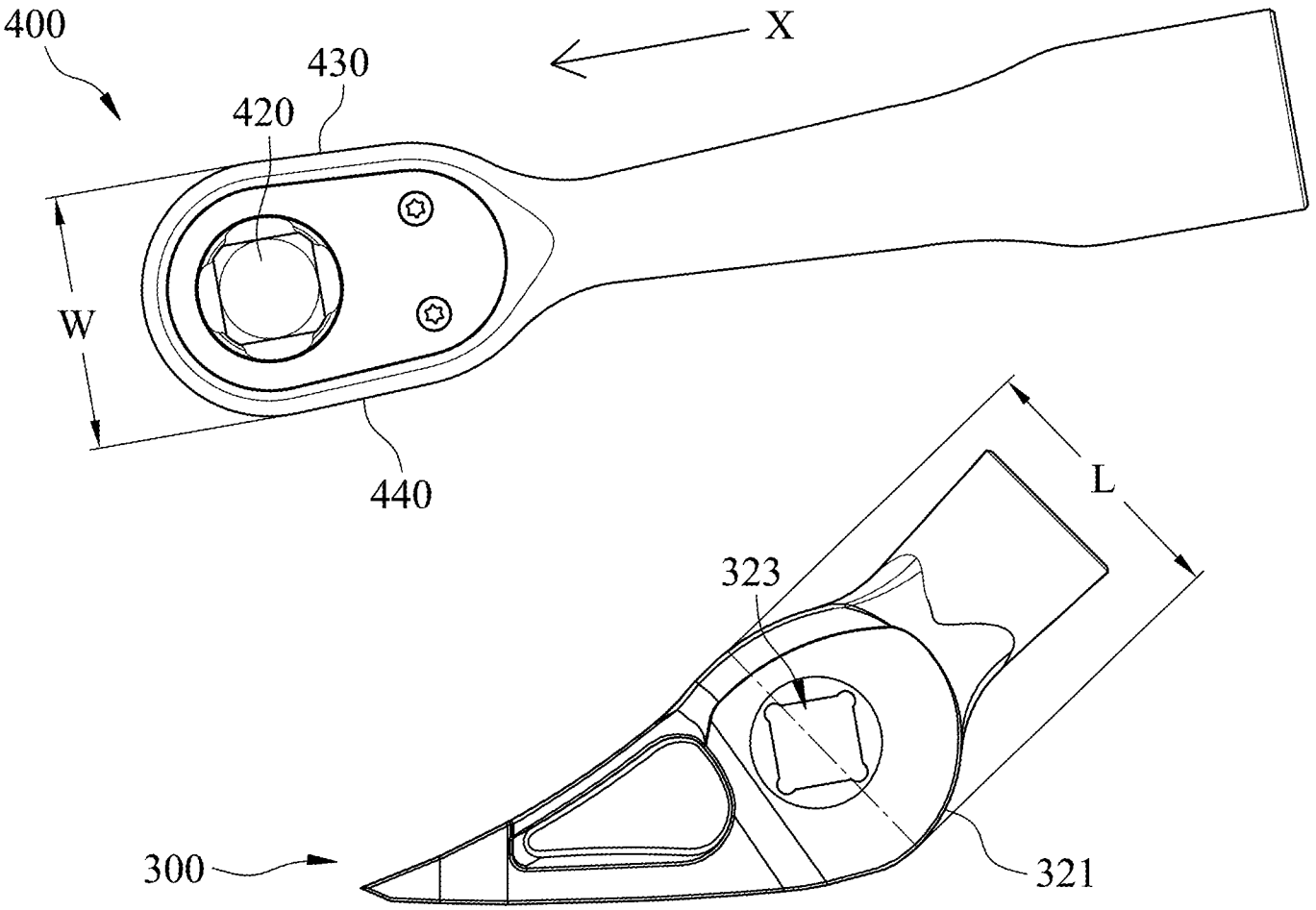
FIG. 7 is a schematic view of the comparison between the size of a supporting portion of a prying head and the size of a wrench head according to the hand tool of FIG. 5.

Please refer to FIG. 7. FIG. 7 is a schematic view of the comparison between the size of the supporting portion 320 of the prying head 300 and the size of the wrench head 400 according to the hand tool 200 of FIG. 5. The handle 500 is engaged with the wrench head 400 along an assembling direction X. The wrench head 400 includes a top surface 430 and a bottom surface 440 extending along the assembling direction X. A length of a shortest chord L of the curved surface 321 of the prying head 300 passing through a center of the through hole 323 can be larger than a longest distance W between the top surface 430 and the bottom surface 440. When the engaging end 420 of the wrench head 400 is engaged with the through hole 323 of the prying head 300, the top surface 430 and the bottom surface 440 of the wrench head 400 are not beyond the curved surface 321 of the prying head 300 as looking from the front side of the hand tool 200. Therefore, the curved surface 321 of the prying head 300 can be a support to lift the heavy article when using the hand tool 200.

Figure 8:
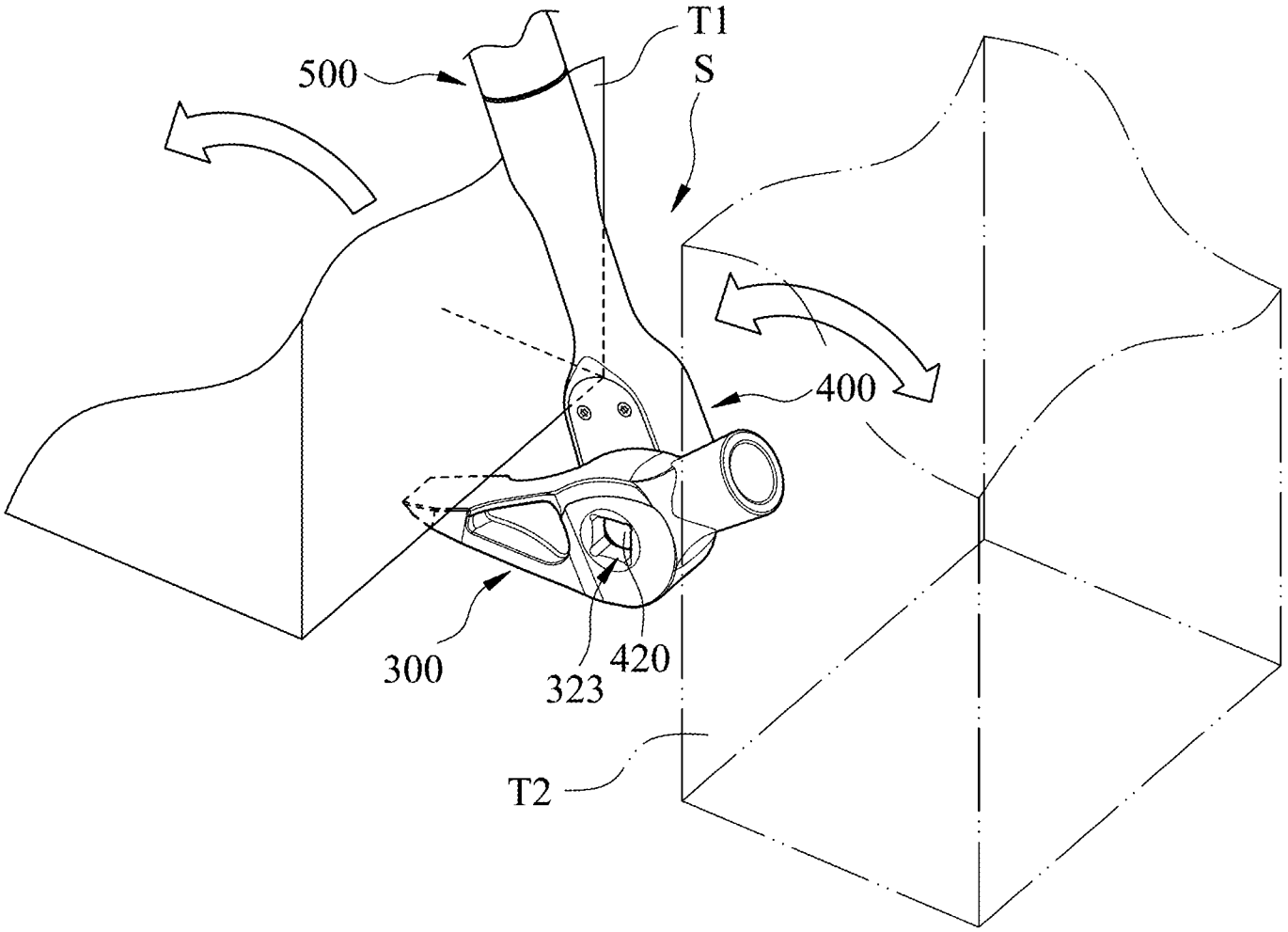
FIG. 8 is a schematic view of using the hand tool of FIG. 5.

Please refer to FIG. 8. FIG. 8 is a schematic view of using the hand tool 200 of FIG. 5. The hand tool 200 of the present disclosure cannot only be used as the conventional crowbar, but is especially suitable for using in limited spaces due to the assembling structure thereof. For example, the hand tool 200 can be used to pry two heavy articles T1, T2, which are adjacent to each other, as shown in FIG. 8. Specifically, as prying the heavy article T1 away from the heavy article T2, it has to pry the heavy article T1 by the hand tool 200 in a small space S between the two heavy articles T1, T2. The hand tool 200 can form a thinner structure by engaging the engaging end 420 of the wrench head 400 with the through hole 323 of the prying head 300. It facilitates the hand tool 200 entering the space S to successfully pry the heavy article T1. Thus, the hand tool 200 can be assembled through the blind hole 331 or the through hole 323 of the prying head 300. The angle between the prying head 300 and the handle 500 can be adjusted according to different situations, which makes the hand tool 200 be more practical.

In this regard, the prying head can be assembled with a handle through the blind hole when using the prying head of the present disclosure. The prying head can be easily detached and stored after using, which enhances the convenience of bringing multiple tools.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A hand tool assembly, comprising:

a prying head, comprising:

a prying portion, comprising:

a ground-abutting surface; and an article-abutting surface, wherein the article-abutting surface is connected to the ground-abutting surface to form a sharp edge;

a supporting portion, which is connected to the prying portion, and the supporting portion comprising:

a curved surface connected to the ground-abutting surface and the article-abutting surface, so as to make an end of the supporting portion away from the sharp edge into a curved form; and a through hole, wherein the through hole penetrates from a first side surface of the supporting portion to a second side surface of the supporting portion opposite to the first side surface; and an assembling portion, which is connected to the supporting portion, and the assembling portion comprising:

a blind hole recessed from an end of the assembling portion away from the sharp edge; and a wrench head comprising an engaging hole and an engaging end, wherein the engaging end protrudes from a side surface of the wrench head, and the engaging end is detachably engaged with the through hole; and a handle comprising an inserting portion, wherein the inserting portion is detachably engaged with the engaging hole of the wrench head or the blind hole of the prying head;

wherein the handle is engaged with the wrench head along an assembling direction, the wrench head comprises a top surface and a bottom surface extending along the assembling direction, a length of a shortest chord of the curved surface of the prying head passing through a center of the through hole is larger than a longest distance between the top surface and the bottom surface, and the longest distance between the top surface and the bottom surface is a width of the wrench head.

2. The hand tool assembly of claim 1, wherein the ground-abutting surface of the prying head is divided into a sudden-narrowing part and a gradual-narrowing part, the sudden-narrowing part is closer to the sharp edge of the prying head than the gradual-narrowing part, and a narrowing rate between the sudden-narrowing part and the article-abutting surface of the prying head is higher than a narrowing rate between the gradual-narrowing part and the article-abutting surface of the prying head.

3. The hand tool assembly of claim 1, wherein a fulcrum is formed at a connection between the curved surface and the ground-abutting surface of the prying head.

4. The hand tool assembly of claim 1, wherein the prying head further comprises:

at least one recessed cavity recessed from a side surface of the prying portion of the prying head.

5. The hand tool assembly of claim 1, wherein the prying head further comprises:

at least one through cavity penetrating from a first side surface of the prying portion of the prying head to a second side surface of the prying portion opposite to the first side surface.

6. The hand tool assembly of claim 1, wherein the prying head further comprises:

at least one recessed arc recessed from an edge of the article-abutting surface of the prying head.

* * * * *